US005335703A

United States Patent [19]

deJong

[11] Patent Number: 5,335,703

[45] Date of Patent: Aug. 9, 1994

[54] RECHARGEABLE DUST-OFF DEVICE AND A METHOD OF USING THE DEVICE

[76] Inventor: Michael deJong, 719 Yonge St., Suite 205, Toronto, Ontario, Canada, M4Y 2B5

[21] Appl. No.: 963,642

[22] Filed: Oct. 20, 1992

[51] Int. Cl.[5] ..... B65B 1/04; B65B 3/04

[52] U.S. Cl. ..... 141/20; 141/18; 141/38; 15/406; 15/344; 134/102.2

[58] Field of Search ..... 141/2, 3, 18, 20, 38; 222/402.16, 3, 630, 399, 394; 15/300, 405, 406, 344; 134/166 R, 166 C, 167 R, 167 C, 168 R, 168 C, 169 A, 169 R, 169 C, 102.2, 100.1; 239/346, DIG. 21; 128/205.22, 205.24, 200.24, 201.27, 201.28, 204.18, 205.21, 205.22, 205.24, 205.25, 205.23; 220/582; 251/353

[56] References Cited

U.S. PATENT DOCUMENTS

| | | | |
|---|---|---|---|
| 2,680,546 | 6/1954 | Seaberg | 226/20.6 |
| 2,841,190 | 7/1958 | Scheck | 141/20 |
| 3,169,670 | 2/1965 | Hrebenak et al. | 222/95 |
| 3,186,407 | 6/1965 | Morrison | 128/205.25 |
| 3,238,940 | 3/1966 | Kopas | 128/205.25 |
| 3,592,244 | 7/1971 | Chamberlin | 141/14 |
| 3,934,622 | 1/1976 | Vitack et al. | 141/18 |
| 4,174,811 | 11/1979 | Binder et al. | 141/20 |
| 4,619,297 | 10/1986 | Kocher | 141/20 |
| 4,648,431 | 3/1987 | Strongert et al. | 141/18 |
| 4,702,243 | 10/1987 | Smith | 128/205.25 |
| 4,917,156 | 4/1990 | Varlet | 141/20 |
| 4,921,020 | 5/1990 | Pamper | 141/20 |
| 4,947,739 | 8/1990 | Owen | 141/18 |
| 4,949,889 | 8/1990 | Carson | 128/205.22 |
| 4,996,982 | 3/1991 | Williamson | 128/205.24 |

*Primary Examiner*—Henry J. Recla
*Assistant Examiner*—Steven O. Douglas
*Attorney, Agent, or Firm*—Hill, Steadman & Simpson

[57] ABSTRACT

A system cleans or dusts devices, such as optical or photographic equipment or the like, with pressurized air from a chamber. The chamber is filled with air through an air inlet valve which may be connected to an air pressure source, such as a conventional tire pump, or may have a built-in pump connected thereto. As a result, when air is depleted from the chamber, the chamber may be re-filled for repeated use of the system.

6 Claims, 2 Drawing Sheets

RECHARGEABLE DUST-OFF DEVICE AND A METHOD OF USING THE DEVICE

The present invention is related to pending U.S. patent application filed Sep. 29, 1992 having U.S. Ser. No. 07/953,519, herein incorporated by reference in its entirety.

BACKGROUND OF THE INVENTION

The present invention generally relates to an aerosol-type device for cleaning equipment such as that used for photography, in a laboratory, and computer and video equipment. More specifically, the invention relates to a device which may be repetitively filled with compressed air using a valve which allows a bike pump or gas station pump to fill the device. Alternatively, a built-in pump connected to an inlet valve to the chamber may be implemented for introducing compressed air into the device.

Devices are known for spraying air or gases for cleaning equipment requiring blasts of air in a specific area. A drawback of these prior art devices, however, is that once the air or gas within the device is depleted, the device must be re-purchased for the device to be re-used.

Prior art devices are known, such as that disclosed in U.S. Pat. Nos. 2,841,190 and 4,648,431, for refilling containers with a medium, such as compressed gas.

U.S. Pat. No. 2,841,190 to Scheck discloses two methods for refilling a container. The first method is known as "cold filling", and the second method requires a separate container having a main valve to permit supply of a propellant, such as Freon. This requires insertion of a valve body including a valve mechanism to connect to the container and to a separate container holding the propellant.

U.S. Pat. No. 4,648,431 the Strongert et al. discloses a valve housing with an inlet having a threaded connection for a compressor conduit provided in a valve body connected to the housing. An outlet for compressed air from the compressor is provided in the side of the housing and is connected with the gas container by means of a threaded attachment and hose coupling. The arrangement requires an inlet valve and an outlet valve in the form of a check valve for reducing the effects of hose breaks. In addition, a throttle noble is required for protecting against overly rapid discharging of the gas.

SUMMARY OF THE INVENTION

The present invention provides an apparatus for cleaning devices, such as video equipment or the like, using pressurized air. The device sprays air from a chamber through a spout which directs the air to clean hard-to-clean areas of the devices. Furthermore, the device includes a chamber for repetitively refilling after the air has been depleted therefrom.

In an embodiment, an adaptor having a threaded open end is connected to an open end of the chamber. In addition, an intermediate section of the adaptor has an opening perpendicular to opposite threaded open ends for receiving an inlet valve. Air from a pump connects to the inlet valve for filling the chamber. An activator initiates release of the air from the chamber by an outlet valve connected between the chamber and the activator. A tubular spout connects to an opening in the side wall of the activator for specifically directing the air from the chamber.

Additional features and advantages of the present invention are described, and will be apparent from, the detailed description of the presently preferred embodiments and from the drawings.

DESCRIPTION OF THE PRESENTLY PREFERRED EMBODIMENTS

Figure 1:
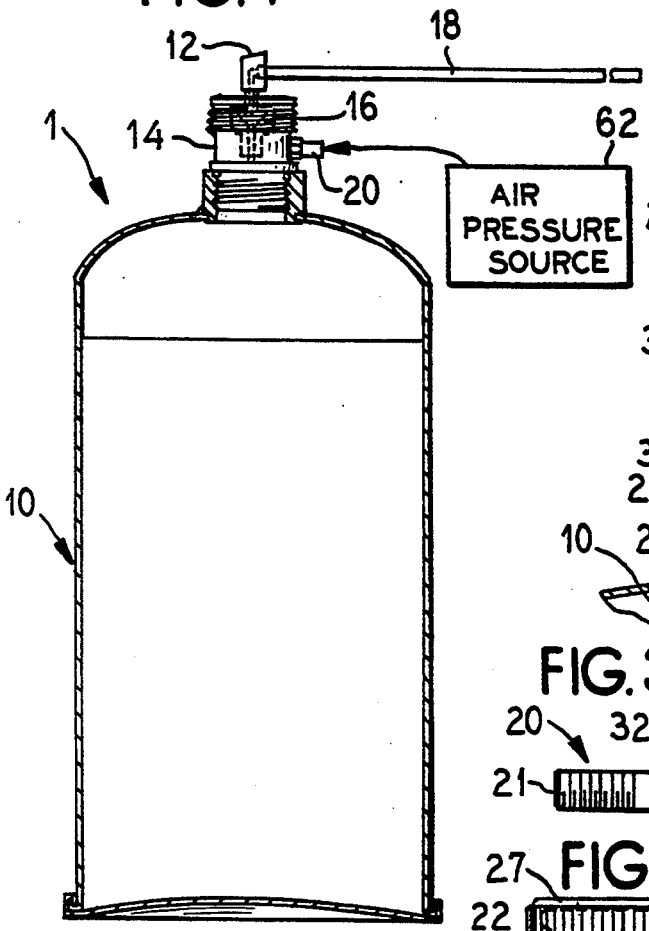
FIG. 1 is a cross-sectional view of a rechargeable dust-off device incorporating the features of the present invention.

In accordance with the invention described with reference to the accompanying Figures wherein like numerals designate like parts, a system 1 shown in FIG. 1 is provided for dispensing compressed air stored within a chamber 10 by depressing an activator 12 forcing the air within the chamber 10 through an adaptor 14, an air outlet valve 16, the activator 12 and finally through a spout 18. A one-way air inlet valve 20 is connected to an opening in the side wall of the adaptor 14 for refilling of air into the chamber 10 using a conventional air pressure source 62, such as a bike pump, tire pump, gasoline station pump, built-in pump or the like.

Figure 2:
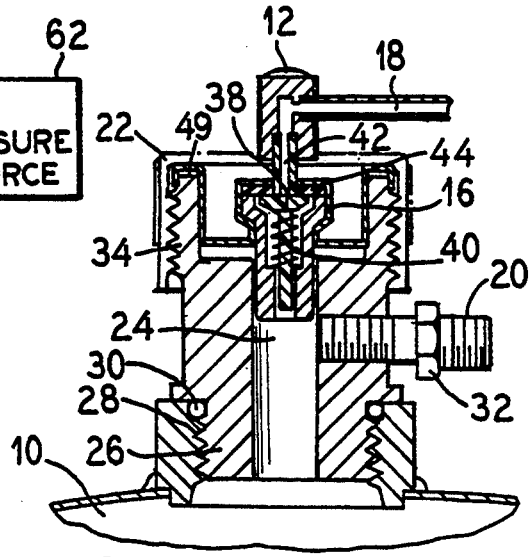
FIG. 2 is an enlarged cross-sectional view of an inlet valve, an outlet valve, an adaptor and an activator as connected between the spout and chamber of the present invention.
Figure 7:
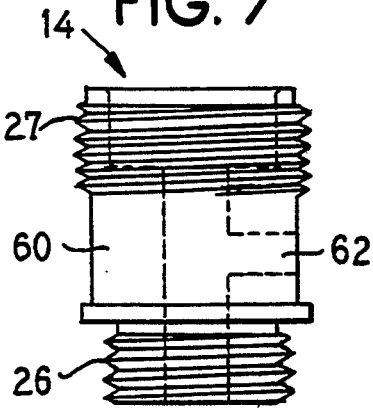
FIG. 7 is a side elevational view of the adaptor for use in the present invention.

FIG. 2 is an enlarged view of the components connected to the adaptor 14. A cover 22 encloses the threaded open end of the adaptor 14 and secures the adaptor 14 with the outlet valve 16. The adaptor 14 has a vertical passageway 24 substantially extending between the chamber 10 and the outlet valve 16. The adaptor 14 has an externally threaded lower end (as shown in FIG. 7) connected to an internally threaded open end 28 of the chamber 10. An O-ring 30 provides sealed engagement therebetween.

Through a side wall of the adaptor 14 is connected the air inlet valve 20 in threaded and sealed engagement. The air inlet valve 20 extends to the vertical passageway 24 of the adaptor 14 for air to be supplied to the chamber 10. The air inlet valve 20 is a standard one-way valve having opposite threaded ends 21, 23 separated by a hexagonal nut 32. The opposite open end 34 of the adaptor 14 may be threadably connected to the cover 22.

The outlet valve 16 includes a plunger 38 biased by a spring 40 such that when the activator 12 is depressed by, for example, a finger of a user, the plunger 38 depresses allowing release of air from the chamber 10 to be forced through a vertical channel 42 and into the activator 12 which redirects the air through the spout 18. The spring 40 is biased to force the plunger 38 into a closed and sealed position. A washer 44 seals the opening between the plunger 38 and the vertical channel 42. In addition, a second washer 49 may be crimped at an open end of the adaptor 14 for sealed engagement between the adaptor 14 and the outlet valve 16 at the open end of the adaptor 14 around which the cover 22 is positioned.

Figure 3A:
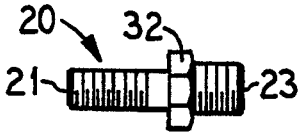
FIGS. 3A and 3B are a side elevational view and top view, respectively, of the inlet valve of the present invention.
Figure 3B:
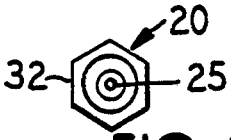

The components of the invention are further detailed in FIGS. 3A, 3B and 4–9 which will hereinafter be described. As shown in FIGS. 3A and 3B, the air inlet valve 20 has the opposing threaded ends 21, 23 separated by the hexagonal nut 32. The threaded end 21 is slightly smaller in diameter than the threaded end 23. The threaded end 23 connects to the air pressure source 62, such as a standard bicycle pump or other air pump as is conventionally known. As shown in FIG. 3B, an inlet 25 is provided in the air inlet valve 20 for air to enter from the air pressure source 62 through the threaded end 23 and the opposite threaded end 21 and finally into the chamber 10 of the system 1.

Figure 4:
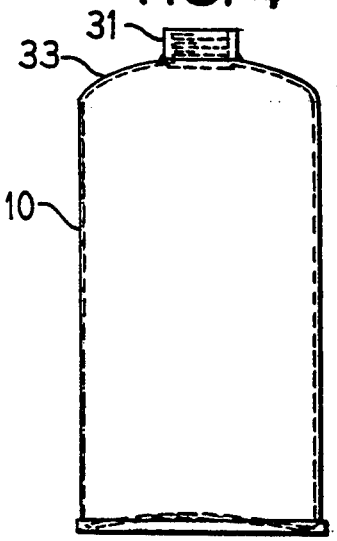
FIG. 4 is a side elevational view of a chamber for containing air for the present invention.

FIG. 4 illustrates the chamber 10 for containing the pressurized air of the present invention. The chamber 10 has an internally threaded open end 31 for securing one end of the adaptor 14 therein. The chamber 10 may be made of a metal, such as aluminum or other suitable material, for holding air at a pressure up to 300 p.s.i. The chamber 10 has a height substantially greater than its width with a tapering, rounded neck 33 extending between the substantially equivalent diameter of the chamber 10 and the diameter at the open end 31. The open end 31 has a substantially smaller diameter than the diameter of the chamber 10.

Figure 5:
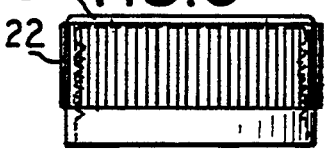
FIG. 5 is a side elevational view of the cover attached to the adaptor (shown in phantom) of the present invention.

FIG. 5 illustrates the cover 22 connected to the end of the adaptor 14. The cover 22 may, therefore, be threadably attached to an opposite externally threaded end of the adaptor 14 as shown in FIG. 2 for connecting the adaptor 14 to the outlet valve 16. Although the cover 22 is shown having a threadable connection to the adaptor 14, it should be understood by those skilled in the art that the cover may be secured in other known conventional manners, such as crimping. The cover 22 includes a through-hole 27 through which the activator 12 is connected to the outlet valve 16.

Figure 6:
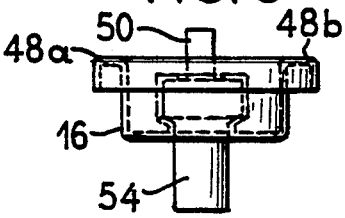
FIG. 6 is a side elevational view of the outlet valve of the present invention.

FIG. 6 illustrates the outlet valve 16 which fits inside the adaptor 14 for releasing air from the chamber 10 through the adaptor 14 and outlet valve 16 to the spout 18. The outlet valve 16 fits over the adaptor 14 as is substantially shown in phantom in FIG. 6. The upper portion of the outlet valve 16 has two portions **48*a*, 48*b*, which extend over the upper threaded end of the adaptor 14. A central portion 50 of the outlet valve 16 is designed to receive the activator 12 for depressing a spring-biased plunger-type valve 38 which releases air from the chamber 10 when the activator 12 is depressed as is conventionally known. The spring-biased valve 38 extends within a narrow lower stem 54 of the outlet valve 16 which extends longitudinally from substantially the center of the central portion 50. The lower stem 54 thereby forms a portion of the passageway for air passing from the chamber 10 through to the spout 18**.

FIG. 7 illustrates the adaptor 14 to be used in the present invention necessary for connecting the inlet valve 20 to the chamber 10 for filling with air as well as for connecting the outlet valve 16 to the chamber 10 for allowing the release of air in the chamber 10 when desired. The adaptor 14 has an upper threaded end 27 and a lower threaded end 26 with a central section 60 located intermediate threaded ends 26 and 27 unitarily forming the adaptor 14. The central section 60 has an opening 62 in its side wall for threadably receiving the inlet valve 20. In addition, an O-ring 30 (shown in FIG. 2) is included for sealing the point at which the chamber 10 meets the adaptor 14 thereby preventing any substantial release of air from the chamber 10.

Figure 8:
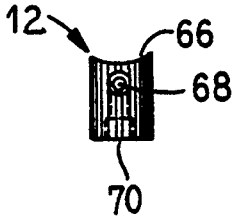
FIG. 8 is a plan view of the activator used in the present invention.

FIG. 8 illustrates the activator 12 of the present invention which includes a depressible cap 66 with an aperture 68 connected to an inlet 70 to the activator 12 such that when the cap 66 is depressed, air is released from the chamber 10 and forced through the inlet 70 and out the aperture 68 and, in turn, through the spout 18.

Figure 9:
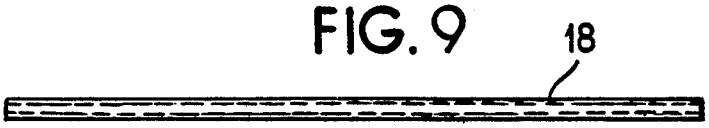
FIG. 9 is a side elevational view of the spout for connection to the activator of the present invention.

FIG. 9 illustrates the spout 18 for connection to the aperture 68 of the activator 12. The spout 18 may be sealingly connected within the aperture 68 to prevent leakage of air passing through the activator 12 into the spout 18 at the point of connection. The spout 18 may typically be a long, flexible material for directing air from the chamber 10 to a very specific area on a piece of equipment, such as equipment in a laboratory, computer equipment, photographic equipment or the like.

The device of the present invention, therefore, operates in the following manner. When the chamber 10 is empty, i.e. no compressed air is contained therein, a the air pressure source 62 such as that shown in FIG. 1 may be attached to the air inlet valve 20 to force air into the chamber 10. The air is stored in the chamber 10 until required for use. Optionally, a built-in pump may be used integral with the system 1.

To use the stored air in the chamber 10, the activator 12 located atop the air outlet valve 16 is depressed forcing the air to travel from the chamber 10 through the adaptor 14 which operatively connects the air inlet valve 20 and the air outlet valve 16 to the system 1. The air, therefore, is forced through a channel in the adaptor 14 aligned with the air outlet valve 16 and a channel in the activator 12. The air is then re-directed at substantially a 90° angle in the activator 12 to be forced through a spout 18 and onto an area of the equipment to be cleaned.

Many devices may be cleaned by the pressurized air within the chamber 10 before depletion depending on the amount of area to be cleaned. In addition, cleaning with no spout or different spouts is contemplated for cleaning smaller or larger surface areas as desired.

Once the air from the chamber 10 is depleted, the chamber 10 may be repressurized by reconnecting the air pressure source 62 to the inlet valve 20. It is further contemplated that a permanent built-in pump may be attached to the inlet valve 20 thereby eliminating the need to have an external pump to be accessed for filling the chamber 10. Furthermore, a pressure gauge (not shown) connected to the chamber 10 is contemplated for monitoring pressure within the chamber 10. An air inlet valve connected at the base of the chamber 10 either alone or adjacent a pressure gauge is further contemplated.

Figure 10:
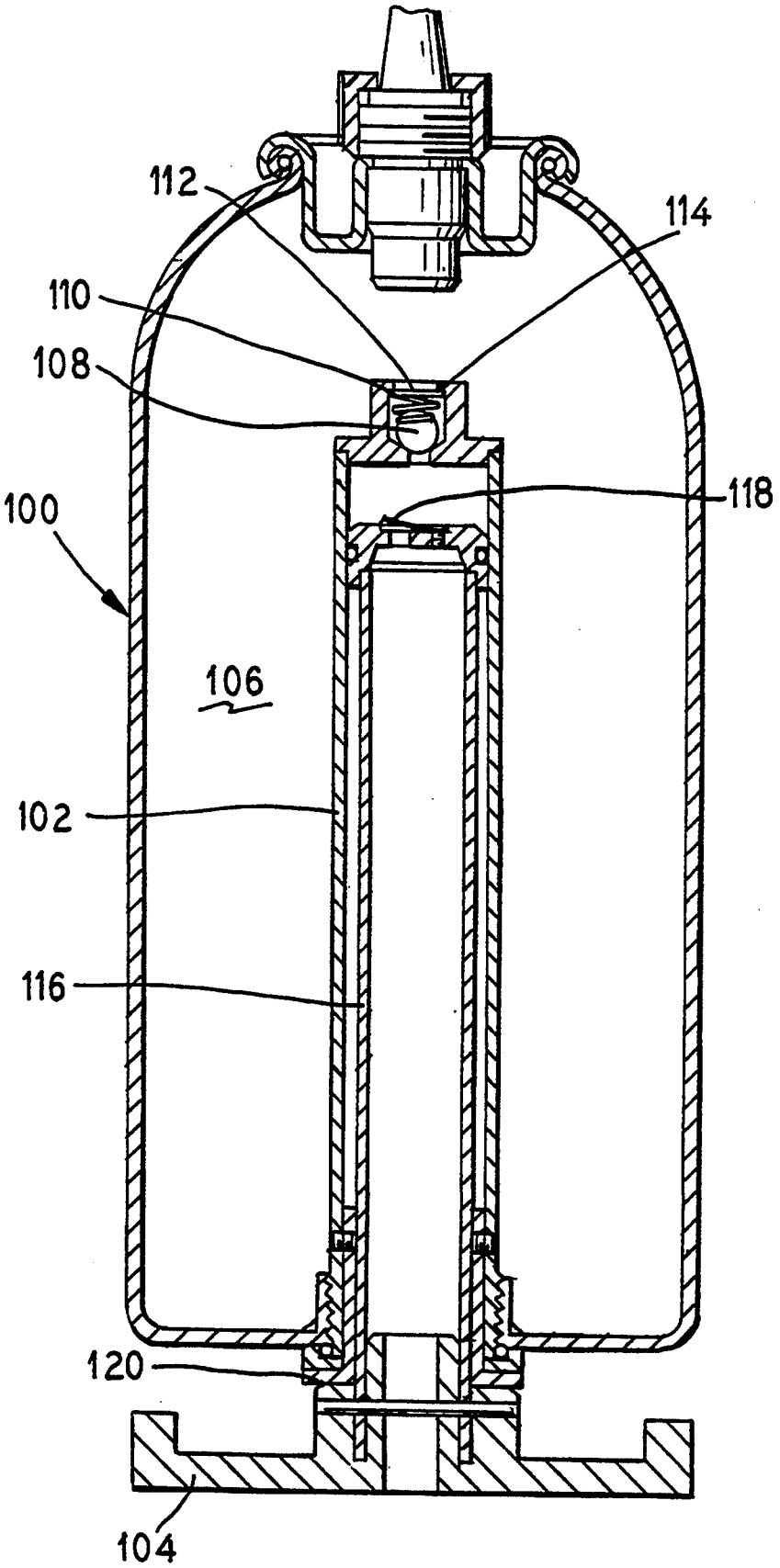
FIG. 10 illustrates a cross-sectional view of an embodiment of a chamber having a built-in pump for recharging the chamber with air.

In an embodiment of the present invention, a built-in pump is illustrated in FIG. 10. A chamber 100 is provided within an interior channel 102 and a retractable base 104. The retractable base 104 provides a handle for pumping air into the interior 106 of the chamber 100. The retractable base 104 may be configured for the chamber 100 to stand thereon when not in use. The retractable base 104 may be shaped or configured for gripping thereof by a user.

A valve 108 is seated securely by, for example, a spring 110, at an opening 112 to the chamber 100 at the top of the interior channel 102. A stop 114 secures the spring 110 and allows the valve 108 to transpose away from the opening 112 which the valve 108 is sealing when air is forced into the interior 106 of the chamber 100 with pumping action of a tube 116 attached to the base 104. The tube 116 is pressed into the channel 102. At the end of the tube 116 opposite the base 104 is a valve 118 in the form of a flapper valve which allows pumped air therethrough when open and prevents air from escaping when closed. A second stop 120 is provided at the end of the chamber 100 preventing the tube 116 from complete removal from the channel 102. Further, the stop 120 provides a mating fit for the retractable base 104 when the pumping of air in the chamber 100 is not required. To pump air, the retractable base 104 extends outwardly with the tube 116 from the chamber 100 and provides for pumping of air into the interior 106 of the chamber 100.

Although this arrangement reduces the capacity of air which can be stored within the interior 106 of the chamber 100, no external pump is required for attachment to a valve at the base of the chamber 100. Of course, other embodiments for implementing an integral pump or built-in pump are contemplated and may be implemented by those skilled in the art given the embodiment illustrated in FIG. 10.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim as my invention:

1. An apparatus for cleaning a device with pressurized air by spraying air from a chamber filled with pressurized air from an air pump, said chamber capable of repetitively refilling after said air has been depleted, said apparatus comprising:

an adaptor having a first exterior threaded open end for connecting to an open end of said chamber, a second exterior threaded open end opposite said first threaded open end, and an intermediate section integrally connecting said threaded ends having an opening perpendicular to said threaded open ends, said opening being interior threaded;

an inlet valve for receiving said air from said air pump having a threaded end connected to said opening of said adaptor and an opposite end for connecting said air pump;

an activator for initiating release of said air from said chamber having a first opening at a base end thereof and a second opening perpendicular to its base end and through a side wall thereof with means associated therewith for spraying said air, whereby said device is cleaned with said air; and an outlet valve having an end which sealingly fits within said second open end of said adaptor and an opposite end connected to said open end at the base end of said activator wherein said outlet valve responds to pressure applied to said activator to release air from said chamber.

2. The apparatus of claim 1 further comprising:

a flexible tubular spout for connecting to said second opening in said side wall of said activator for directing said air to a specific point.

3. The apparatus of claim 1 wherein said air pump is a tire pump.

4. The apparatus of claim 1 wherein said air pump is an integral pump connected to said opposite end of said inlet valve.

5. The apparatus of claim 1 wherein said chamber may be filled to 300 p.s.i.

6. The apparatus of claim 1 further comprising:

a cover for securing said adaptor and said activator.

* * * * *